United States Patent [19]

Weis

[11] Patent Number: 4,521,214

[45] Date of Patent: Jun. 4, 1985

[54] CONTINUOUS GRADIENT DYEING OF PLASTIC RIBBON

[75] Inventor: Robert Weis, Leominster, Mass.

[73] Assignee: American Hoechst Corporation, Somerville, N.J.

[21] Appl. No.: 569,427

[22] Filed: Jan. 9, 1984

Related U.S. Application Data

[62] Division of Ser. No. 429,653, Sep. 30, 1983, Pat. No. 4,442,788.

[51] Int. Cl.[3] ..... B05C 3/02

[52] U.S. Cl. ..... 8/506; 8/519; 8/154; 118/405; 118/419; 427/164

[58] Field of Search ..... 68/9, 175; 8/151, 519, 8/506; 427/164; 118/405, 419, 694, 712, 67

[56] References Cited

U.S. PATENT DOCUMENTS

| | | | |
|---|---|---|---|
| 2,522,071 | 9/1950 | Tait | 134/122 |
| 2,588,973 | 3/1952 | Fitch et al. | 95/94 |
| 3,113,034 | 12/1963 | Fix | 8/151 X |
| 3,385,745 | 5/1968 | Mears | 156/345 |
| 3,831,551 | 8/1974 | Kime | 118/694 |
| 3,862,553 | 1/1975 | Schwemmer et al. | 118/694 X |
| 3,881,509 | 5/1975 | Newton | 118/694 X |
| 3,964,434 | 6/1976 | Adler et al. | 118/405 |
| 4,138,284 | 2/1979 | Postupack | 427/164 X |
| 4,190,418 | 2/1980 | Buzzell | 8/4 |
| 4,258,653 | 3/1981 | Buzzell | 118/419 |
| 4,388,375 | 6/1983 | Hopper et al. | 428/423.7 |
| 4,396,646 | 8/1983 | Schuler et al. | 427/163 |
| 4,428,980 | 1/1984 | Nakamura et al. | 427/164 X |
| 4,442,788 | 4/1984 | Weis | 118/405 |

FOREIGN PATENT DOCUMENTS

| | | | |
|---|---|---|---|
| 1592695 | 6/1970 | France | 427/164 |

*Primary Examiner*—Philip R. Coe
*Assistant Examiner*—Frankie L. Stinson
*Attorney, Agent, or Firm*—Tatsuya Ikeda; Hugh C. Crall; John P. Blasko

[57] ABSTRACT

There is described a process for producing, in a continuous manner, a gradient dyeing across the width of a long strip of a plastic sheet and an apparatus used therefor. In a preferred embodiment of the invention, the orientation of the plastic strip is maintained substantially constant during the passage through a dye bath, and the dye liquid level is repetitively varied by use of a liquid level control means. This invention is particularly useful for making gradient-dyed plastic sheets which in turn are used for making sunglass lenses.

8 Claims, 1 Drawing Figure

CONTINUOUS GRADIENT DYEING OF PLASTIC RIBBON

This is a division of patent application Ser. No. 06/429,653, filed Sept. 30, 1983 now U.S. Pat. No. 4,442,788.

BRIEF SUMMARY OF THE INVENTION

1. Technical Field

This invention relates to a method for the continuous gradient dyeing of a long plastic strip (ribbon) and an apparatus used therefor. The invention is particularly useful for the purpose of making sunglass lenses having a gradient tint.

2. Background Art

To many people, gradient tint is an attractive feature of sunglasses. Usually, gradient dyeing of plastic sunglass lenses is conducted batch-wise by vertically mounting individual shaped lenses or lens blanks in a tray, immersing the tray in a dye bath solution and cyclically changing with time the vertical position of the tray while keeping the dye liquid level constant during the dyeing process. This method, however, is a batch process and therefore entails a considerable amount of labor cost. Such gradient dyeing of plastic sunglass lenses is often conducted on a large number of so-called lens blanks for the purpose of supplying them to manufacturers of sunglasses. Such lens blanks have an approximately square shape and the individual sunglass manufacturers purchasing such gradient dyed lens blanks cut them into desired shapes to fit them into various sunglass frames.

In such a situation, there is obviously a considerable amount of wasted material. This is because the person conducting the gradient dyeing does not known, or cannot economically make adjustments to the shapes and sizes of the sunglass lenses used by the individual sunglass manufacturers. If a continuous long strip of plastic ribbon can be gradient dyed by a continuous process, it will reduce the production costs for the dyeing process and the material loss, because the individual sunglass manufacturers can cut out individual shaped lenses from the dyed plastic ribbon with a small amount of material loss by arranging the cutting lines on the ribbon very close to each other. In light of the fact that certain plastic materials such as cellulose acetate, cellulose acetate butyrate and hard coated polarized sheets comprising layers of cellulose acetate butyrate which are commonly used for sunglass applications are flexible so that ribbons made from such materials can be rolled up and also withstand a considerable amount of bending force as well as tensile force without sustaining physical damage, it will be very desirable to develop a continuous process for gradient dyeing long strips of such flexible materials taking advantage of such physical properties of the plastic ribbons.

U.S. Pat. No. 2,522,071 to Tait discloses a method and apparatus for the continuous treatment of a strip material in liquid, wherein the strip is passed edgewise through a bath. The strip goes through two vertical slots provided in two opposing bath walls. The slots are substantially sealed by the use of flexible flaps. Areas of application of Tait invention includes degreasing, pickling, dipping, brightening, electrolytic polishing and proofing processes such as bondering, anodising and chromate treatment of steel or other metallic or other strips. In Tait, the strip is always maintained straight in the bath without any looping. It appears that Tait contemplated treatment of sheets having substantial thickness and rigidity. There is no disclosure about plastic strips, looping of the strip inside the bath, or gradient dyeing of the strip.

U.S. Pat. No. 2,588,973 to Fitch et al describes an apparatus for applying a band of solution to an edge of motion-picture film, whereby a film treatment solution is applied to a predetermined area of the film. This device produces two sharply contrasting zones, one being the treated band and the other untreated band, and hence is not applicable to gradient dyeing of plastic ribbons.

U.S. Pat. No. 3,964,434 to Adler et al describes an apparatus for the automated processing of substances carried upon or affixed to a surface of a continuous strip such as a ribbon or a tape. The strip is treated sequentially with a plurality of fluids including reactants maintained in separate chambers. Adjacent treating chambers are separated by a hollow-wall, which constitutes an isolation chamber. Each isolation chamber has in-line opposing slots disposed below the level of the liquid reagents in the adjacent treating chambers. Typically, the material treated in Alder et al invention is a tape containing biological smears. Alder et al disclose, among others, a looping arrangement of the tape inside the bath, but their device is not applicable to the gradient dyeing of plastic ribbons.

DISCLOSURE OF THE INVENTION

In response to the need for a continuous process for gradient dyeing a continuous ribbon of a plastic material, this invention affords a method for continuously producing a gradient tint across the width of the ribbon wherein the ribbon is continuously passed through a dye bath. In a preferred embodiment of the invention, the plane of said ribbon is maintained at a substantially constant angle, preferably at a vertical angle, with respect to the dye liquid surface, the liquid level is repetitively varied with time between two prescribed levels by a liquid level control means, and the temperature of the dye bath is controlled by a dye bath temperature control means. In another embodiment of the invention, the orientation of the ribbon surface is changed during the passage through the dye liquid between two extreme orientations, one being substantially horizontal and the other substantially vertical. Such change of the orientation between the two extremes may occur more than once during the residence time. Preferably, the depth of the tint in the dyed portion of the ribbon is continuously or periodically monitored by use of a means for determining the optical transmission of the dyed ribbon and an adjustment is made in response to the optical transmission data in order to maintain the depth of tint substantially constant with time. This invention also discloses an apparatus for accomplishing said method which comprises a feed reel, a take-up reel, a ribbon drive means and a dye bath temperature control means, a rinsing unit, and a drying unit. Preferably, the apparatus also comprises a means for determining the optical transmission of the dyed ribbon such as an optical sensor placed downstream of the dye tank which monitors the depth of tint of the dyed ribbon. Preferably the apparatus further comprises a means for attaching a thin protective plastic film to both sides of the dyed ribbon, said means being provided between the drying unit and the take-up reel.

Figure 1:
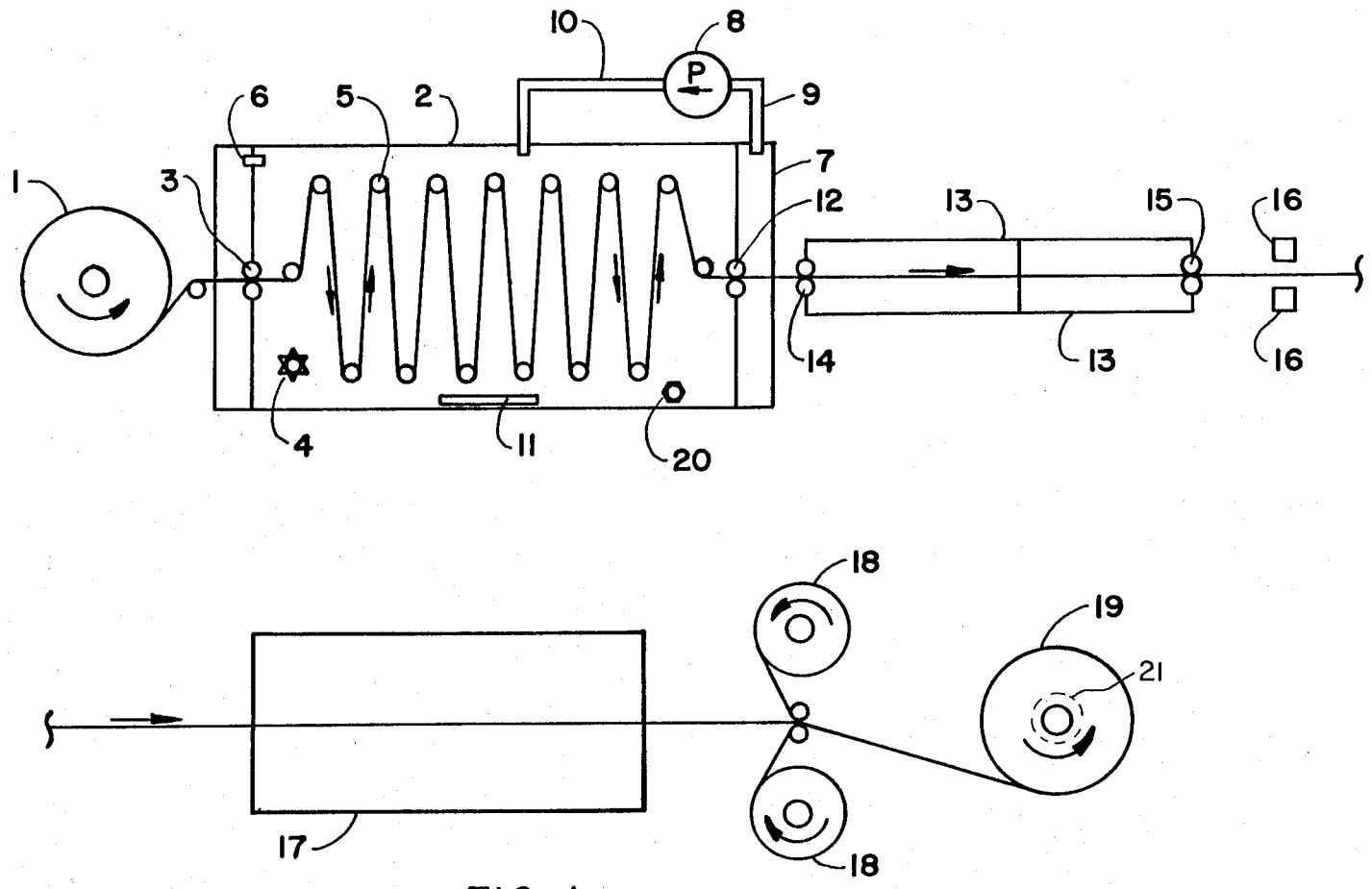
FIG. 1 is a schematic diagram of a preferred embodiment of the apparatus of this invention as viewed from the top in which a plastic ribbon is maintained in a substantially vertical orientation in a dye tank.

It comprises a feed reel 1, a dye tank 2, an overflow tank 7, a rinsing tank 13 having two compartments, an optical sensor 16, a drying oven 17, a pair of rollers 18 which provides a protective film on both sides of the dyed ribbon, and a take-up reel 19 as well as a ribbon drive means 21 which is shown symbolically.

DETAILS OF THE INVENTION

The term "gradient dyeing" of a plastic ribbon as used herein means dyeing a plastic ribbon in such a way that there is a gradual change of the depth of color across the width of the ribbon. Such gradual change of the depth of the color is very attractive to sunglass consumers and hence gradient dyeing of sunglass lenses is a commercially important process in sunglass production.

The term "ribbon" as used herein means a strip the width of which is narrow in comparison to the length. The term "continuous ribbon" as used herein merely signifies that the ribbon is long, for instance, of the order of one hundred feet or longer. In the case of plastic ribbons used for sunglass applicantions the ribbon has a typical width of about 2.5 inches. Gradient dyeing is provided across this width, one edge of the ribbon being the darker dyed side. Usually there is a band in the ribbon which is not dyed at all. Thus, typically, the dye solution is allowed to come up to the maximum height of about $\frac{2}{3}$ of the width of the ribbon. The minimum height to which the dye solution is allowed to come down is typically a fraction of an inch from the lower edge of the ribbon.

According to the method of this invention, a continuous ribbon of a plastic material is gradient-dyed in a continuous manner as opposed to a batch-wise manner. As mentioned earlier, this affords a substantial saving of manufacturing cost. The depth of the tint in the dyed portion of the ribbon is maintained substantially constant during the operation of the dyeing process. The position of the dyed area of the ribbon with respect to the width of the ribbon is also maintained substantially constant with respect to time. In a preferred embodiment of the invention, there is provided a means for maintaining the plane of the ribbon at a substantially constant angle, preferrably at a vertical angle, with respect to the dye liquid surface, and a means for repetitively changing with time the liquid level between two pre-determined levels. Any conventional means may be used for said purpose of maintaining the plane of the ribbon at a substantially constant angle. Where the ribbon surface is to be maintained vertical during the passage through the dye solution, said purpose can be accomplished, for instance, by vertically positioning the feed reel, the take-up reel and an entry and exit slot provided in the dye tank. By virtue of the liquid level control means, the liquid level of the dye bath is varied with time in a precisely repetitive manner. Thus, the gradient dyeing pattern across the width of the ribbon is maintained substantially constant during the entire period of operation.

In another embodiment of the invention, the orientation of the ribbon surface is changed during the passage through the dye liquid between two extreme orientations, one being substantially horizontal and the other substantially vertical. Such change of the orientation between the two extremes may occur more than once during the residence time. The initial orientation of the ribbon at the point of entry into the dye bath is not critical as long as the mode of variation of the ribbon orientation during the passage through the dye bath is suitable to produce a gradient tint across the width of the ribbon. For instance, the ribbon may enter the bath horizontally and the orientation may be changed gradually until it exits from the bath vertically, or vise versa. Any conventional means may be used for providing such gradual change of the ribbon orientation during the passage through the bath, for instance, one or more guide rollers may be provided inside the dye tank. In this embodiment, there is no need for repetitively changing the dye liquid level.

It is preferable in this invention to provide a means for determining the optical transmission of the dyed ribbon at a suitable location, preferably between the rinsing unit and the drying unit, which continuously or periodically monitors the depth of tint in the dyed ribbon. In response to variations in the optical transmission, an adjustment is made either automatically or manually on the ribbon immersion time in the bath, the dye bath temperature, dye concentration or combinations thereof.

Plastic materials suitable for this invention are any plastic materials which have sufficient flexibility to be handled in rolled forms and can withstand a reasonable amount of mechanical forces such as bending force and tensile force. Examples of such plastic materials suitable for this invention include cellulose acetate, cellulose acetate butyrate and light polarizing sheets. A light polarizing sheet typically comprises, a central layer of polyvinylalcohol having iodine molecules entrapped therein and, on both sides thereof, a cellulose acetate butyrate layer. In order to improve scratch resistance, such light polarizing sheets usually have a hard coat layer on both sides of the sheet. Such hard coat layer is made of, for instance, melamine formaldehyde resin.

This invention is particularly useful for manufacturing long strips of gradient-dyed plastic sheets used for making sunglass lenses, and a special emphasis will be placed on such sunglass applications hereinafter in describing this invention, it being understood that the invention is not so limited. The following description of the invention is based on the preferred embodiment of the invention.

The ribbon is passed through a dye bath by a ribbon drive means. Usually the undyed ribbon comes as a roll of narrow thin sheet rolled around a feed reel. In the case of sunglass applications, the ribbon typically has a thickness of about 0.03 inch and, as mentioned earlier, a width of about 2.5 inches. Starting from the feed reel, the ribbon goes through a dye tank, a rinsing unit, a drying unit and finally to a take-up reel. Usually a pair of rollers is placed between the drying unit and the take-up reel to apply a protective film on both sides of the dyed ribbon.

The ribbon drive means supplies a driving force for the forward movement of the ribbon from one end of the entire apparatus to the other. Usually a motor and a belt transmit the driving force to the take-up reel which in turn continuously pulls the plastic ribbon. In a preferred embodiment of the invention, said motor is a variable speed motor so that the ribbon speed can be adjusted in response to the changes in the optical transmission of the dyed ribbon. Such adjustment can be made either manually or automatically by providing an appropriate mechanism whereby the speed of the variable speed motor is automatically controlled by the optical transmission data supplied by said means for determining the optical transmission of the dyed ribbon.

The dye tank may be of any suitable shape, but it is usually rectangular. The ribbon enters the dye tank through a slot provided in one of the side walls of the tank. In the preferred embodiment of the invention the plane of the ribbon is maintained at a substantially constant angle with respect of the liquid surface during the passage of the ribbon through the dye bath. It is preferred that the ribbon be maintained generally vertical to the liquid surface at least during the time it passes through the dye bath. Thus, it is preferred to provide two vertical slots in two opposing side walls of the dye tank at the same vertical height to provide an entry and exit means for the ribbon. In order to make effective use of the space inside the dye tank, it is often advantageous to provide a multiple number of rollers inside the dye tank is create a zig-zag path for the ribbon. It is preferred that the entire set of such rollers be vertically arranged with respect to the liquid surface. As a means for adjusting the time during which the ribbon is immersed in the dye solution (hereinafter called immersion time) so as to obtain a constant depth of tint in the dyed ribbon, one can arrange two parallel rows of opposing rollers having a mechanism which adjusts the distance between the two rows and thus changes the total distance of ribbon travel in the dye solution. Such a device is described in Mears U.S. Pat. No. 3,385,745. The immersion time can also be varied by adjusting the speed of the ribbon drive means. In any event, the overall orientation of that portion of the ribbon which is undergoing the dyeing process should preferably be level from one end to the other.

The design of said entry and exit slots is not critical. It is advantageous, however, to prevent an excessive leakage of the dye solution through the slots. For this purpose, one can employ a pair of rollers at each slot. One can also employ a valve structure such as described in Tait U.S. Pat. No. 2,522,071 useful for passing a strip material through the wall of a liquid bath, which is basically a slot having a V-shape flange attached thereto, each portion of the V-shape flange being covered with a solid flap of a resilient material.

The dye tank has associated therewith a liquid level control means whereby the liquid level of the dye bath is repetitively varied with time between two prescribed levels. Various devices may be used for said liquid level control means. In a preferred embodiment of the invention, said liquid level control means comprises a liquid level sensor, a liquid pump, a liquid draining means and an overflow tank. The vertical level of the liquid level sensor is repetitively varied with time by use of, for instance, a cam device. The dye liquid level in the dye tank is constantly varied so as to follow the vertical level of the liquid sensor an any given time. This is accomplished by coupling the liquid level sensor with the liquid pump which pumps the dye liquid from the overflow tank back to the dye tank. At any given moment, if the liquid level is lower than the position of the liquid level sensor, the liquid pump is actuated to correct for this deficiency, and if the liquid level is too high, the liquid pump is shut off and the liquid level decreases by virtue of the natural gravitational flow-out of the liquid through the liquid draining means and the slots. It is desirable that the pumping capacity of the liquid pump be at least twice the average combined rate of the natural flow-out of the liquid through the liquid draining means and the slots. Typically, a valve is used for said liquid draining means. The valve opening is adjusted so as to provide a suitable liquid flow rate out of the tank. The overflow tank receives the dye solution flowing out of the dye tank through the liquid draining means and the slots, and functions as a reservoir for the dye solution re-circulation system. Thus the liquid pump takes in the dye solution from the overflow tank and returns it to the dye tank.

It is desirable in most cases that the liquid level be varied with time in such a manner that a smooth gradient dyeing is obtained across the width of the ribbon. Sinusoidal variation is an example of a preferred manner of liquid level variation with time. It is important that the gradient color pattern across the width of the ribbon does not change from one longitudinal position to another. For this reason, it is desirable, among other things, that any given longitudinal position in the ribbon be exposed to at least a full cycle of liquid level variation during the residence in the dye bath. If the residence time (immersion time) is substantially shorter than the period of a full cycle of liquid level variation, it tends to create an unevenness of the depth of color along the longitudinal direction of the ribbon.

Various types of liquid level sensors are known in the art. An example of liquid level sensor suitable for this invention is ultrasonic type. Such ultrasonic type liquid level sensors make use of the principle that ultrasonic signal passes through a liquid medium but is attenuated in air. The sensor assembly comprises a sensor and a control unit. Typically the sensor has a transmitter and a receiver in a common housing across a fixed gap. The control unit generates an electrical signal that is converted to an ultrasonic signal at the transmitter transducer. When the gap is filled with a liquid medium this signal is transmitted across the sensor gap to the receiver transducer and reconverted to an electrical signal. The signal is amplified in the control unit and a relay is energized. When the liquid level falls below the sensor gap the signal is attenuated.

It is preferable that the dye tank be equipped with at least one mixer which agitates the dye solution so as to maintain the composition and the temperature of the dye solution uniform within the entire dye bath. The term "dye solution" is used in a broad sense in that the dye may not necessarily be dissolved in the liquid medium on a molecular level. The liquid medium may be an aqueous or a non-aqueous system such as described in Haddad et al U.S. Pat. No. 4,245,991, namely a dye bath composition suitable for the dip dyeing of plastic articles comprising glycerol and ethylene glycol. Where gradient dyeing is conducted on hard coated laminated light polarizing sheet comprising layers of cellulose acetate butyrate, it is particularly preferable to use a liquid medium comprising glycerol and ethylene glycol at a relative propertion within the range of from 95:5 to 20:80. Various types of dyes may be employed in this invention. An example of preferred type of dye is a disperse-type dye.

The temperature of the dye solution is controlled by a dye bath temperature control mens. A conventional thermostat-heater combination is suitable for this purpose. Typically, a dye bath temperature is within the range of 170°–210° F., although it is influenced by various factors including the kind of plastic material dyed, the kind of dyestuff used, the kind of liquid medium used, the desired depth of dyeing, the dye concentration, etc.

Ordinarily, the depth of tint of the dyed ribbon does not change rapidly with time as long as the dye bath temperature and the immersion time are controlled. But sometimes an appreciable change of the depth of tint of the dyed ribbon may occur during the dyeing process due to various reasons such as depletion of the dye concentration, and it is often desirable to provide an adjustment mechanism to maintain the depth of tint substantially constant during the dyeing process. In such a case, a means for monitoring the optical transmission of the dyed ribbon such as an optical sensor is provided somewhere between the dye tank and the take-up reel, preferably immediately following the rinsing unit or the drying unit. In response to the variation in the optical transmission of the dyed ribbon, an adjustment may be made in the immersion time, the dye bath temperature, dye concentration or combinations thereof. Such adjustment can be made either manually or automatically. Where the dye bath temperature is adjusted, it means changing the setting of the target temperature of the dye bath temperature control means; for instance, it means changing the thermostate setting. Where the immersion time is adjusted, it means changing either the ribbon speed or the total distance of the ribbon travel in the dye tank. Addition of a fresh supply of dye to the dye bath often cures the problem of gradual decrease of a depth of tint in the dyed ribbon.

The means for determining the optical transmission of the dyed ribbon suitable for this invention is not limited to any particular structure. Typically, however, it comprises a constant intensity light source and a photoelectric unit. The light source directs a beam of light through the ribbon at a preset height along the width of the ribbon and onto the photoelectric unit. The photoelectric unit is calibrated to measure the amount of light penetrating the moving ribbon, and to generate an electric signal which is proportional to the amount of light sensed. It is preferable to place said means for determining the optical transmission between the rinsing unit and the drying unit.

As soon as the plastic ribbon exits from the dye tank it enters a rinsing unit. The rinsing unit may consist of more than one rinse tank each being filled with clean water. Where there are multiple numbers of rinse tanks arranged in series the temperature of the rinse waters may be different from one rinse tank or another. Typically, there are two compartments within a rinse tank, one compartment being maintained at a higher temperature than the other. For example, one compartment may be maintained at 140° F. and the other at 70° F. The rinsing unit preferably has inlet guide rollers and outlet guide rollers. After the plastic ribbon exits from the rinsing unit it enters a drying unit. Typically the drying unit is a forced hot air oven maintained at an elevated temperature, typically within the range of 150° to 200° F. Naturally the temperature of the hot air should not be so high as to damage the quality of the ribbon. Typically, between the rinsing unit and the drying unit there is placed a means for determining the optical transmission of the dyed ribbon as explained earlier. In order to protect the dyed surface of the ribbon from mechanical damage such as scratches, it is preferred to provide a means for coating the dyed ribbon with a protective film of plastic material on either side of the ribbon after the ribbon exits from the drying unit. Finally the ribbon reaches the take-up reel where it is continuously rewound.

FIG. 1 is a top plan view of a preferred embodiment of the apparatus suitable for this invention in which a plastic ribbon is maintained in a substantially vertical orientation in a dye tank. A roll of hard coated, light polarizing plastic sheet (ribbon) is placed on a feed reel 1, and the ribbon is continuously unwound from the feed reel 1 by virtue of a driving force supplied from a ribbon drive means 21 shown symbolically. The plastic ribbon enters the dye tank 2 through a pair of inlet guide rollers 3 and goes through the dye solution in a zig-zag fashion around two sets of guide rollers 5 arranged in two parallel rows. The ribbon exits from the dye tank 2 through a pair of outlet guide rollers 12. The dye tank 2 has a dye bath mixer 4 which keeps uniform the dye bath composition and the temperature throughout the dye tank 2, a drain valve 6 and a dye bath temperature control means 11 which is only symbolically shown in the figure. The dye bath temperature control means 11 actually comprises an immersion heater and a thermostat. The drain valve 6 controls the natural gravitational flow rate of the liquid out of the dye tank 2. The dye liquid flowing out of the dye tank 2 through the drain valve 6 and the guide rollers 3 and 12 is received by an overflow tank 7 which is provided between the dye pump 8 and the dye tank 2. When the dye pump 8 is actuated the dye solution is circulated from the overflow tank 7 back to the dye tank 2. The actuation of the dye pump 8 is accomplished by coupling the dye pump 8 with a liquid level sensor 20. The vertical position of the liquid level sensor is cyclically varied by a cam device (not shown).

AS soon as the plastic ribbon exits from the dye tank 2 it enters a rinsing unit 13. The rinsing unit 13 consists of a rectangular rinsing tank having two compartments each filled with clean water. The first rinsing compartment is maintained at a temperature of 140° F. The inlet side of the rinsing unit 13 has a pair of guide rollers 14. After the first rinsing compartment, the ribbon enters the second rinsing compartment maintained at 70° F. There is a narrow slot provided in the wall which separates the two compartments. A pair of outlet guide rollers 15 is provided in the outlet side of the second rinsing compartment. An optical sensor unit 16 is provided immediately downstream of the rinsing unit 13. It comprises a constant intensity light source (not shown) and a photoelectric unit (not shown), and continuously monitors the optical transmission of the dyed ribbon at a midpoint across the width of the ribbon and the transmission reading is continuously fed to a variable-speed motor constituting a part of the aforementioned ribbon drive means 21. The variable speed motor supplies a driving force to a take-up reel 19, and the speed is automatically adjusted at all times according to the optical transmission data sent from the optical sensor unit 16. For instance, as soon as the optical sensor 16 detects a lower depth of tint in the ribbon than the prescribed value, then an adjustment is made immediately so as to decrease the speed or the ribbon advancement in the dye tank 2 and hence increase the immersion time in the tank. After exiting from the rinsing unit 13, the ribbon enters a drying oven 17 which is a forced hot air oven maintained at about 160° F. Downstream of the drying oven 17 there is provided a pair of rollers 18 which applies a thin protective film of a plastic material to both sides of the dyed ribbon. Finally, the dyed ribbon reaches the take-up roller 19 where it is continuously rewound.

While I have disclosed and described preferred embodiments of the invention. I wish it understood that I do not intend to be restricted solely thereto, but that I do intend to include all embodiments thereof which would be apparent to one skilled in the art and which come within the spirit and scope of my invention.

I claim:

1. A process for producing in a continuous manner a gradient dyed plastic ribbon, wherein said ribbon is passed longitudinally through a dye bath by a ribbon drive means, the plane of said ribbon is maintained at a substantially constant angle with respect to the dye bath surface during the residence of said ribbon in the dye bath, the liquid level of the dye bath is repetitively varied with time between two pre-determined levels by a liquid level control means and the overall orientation of that portion of the ribbon which is undergoing the dyeing process in the dye bath is substantially level from one end to the other.

2. A process according to claim 1 wherein the plane of the ribbon is maintained at an angle substantially perpendicular to the dye bath surface.

3. A process according to claim 1 wherein said continuous ribbon is maintained between a feed reel and a take-up reel.

4. A process according to claim 1 wherein the depth of tint in the dyed portion of the ribbon is monitored by use of a means for determining the optical transmission of the dyed ribbon.

5. A process according to claim 4 wherein a variable speed motor is used for said ribbon drive means and in response to data from said means for determining the optical transmission of the dyed ribbon the speed of the ribbon passage is adjusted from time to time so as to obtain a substantially constant depth of tint in the ribbon.

6. A process according to claim 4 wherein a variable speed motor is used for said ribbon drive means and in response to data from said means for determining the optical transmission of the dyed ribbon the speed of the ribbon passage is adjusted continuously and automatically so as to obtain a substantially constant depth of tint in the ribbon.

7. A process according to claim 4 wherein in response to data from said means for determining the optical transmission of the dyed ribbon the temperature of the dye bath is manually adjusted from time to time so as to obtain a substantially constant depth of tint in the ribbon.

8. A process according to claim 4 wherein in response to data from said means for determining the optical transmission of the dyed ribbon the temperature of the dye bath is adjusted continuously and automatically so as to obtain a constant depth of tint in the ribbon.

* * * * *

UNITED STATES PATENT AND TRADEMARK OFFICE

CERTIFICATE OF CORRECTION

PATENT NO. : 4,521,214

DATED : June 4, 1985

INVENTOR(S) : Robert Weis

It is certified that error appears in the above-identified patent and that said Letters Patent is hereby corrected as shown below:

ON THE FRONT PAGE:

In the left hand column: Item number [73] should read "Assignee: Foster Grant Corporation, Leominster, Mass."

Signed and Sealed this

*Fifteenth* Day of *October 1985*

[SEAL]

*Attest:*

*Attesting Officer*

DONALD J. QUIGG

*Commissioner of Patents and Trademarks—Designate*